United States Patent [19]

Martin

[11] Patent Number: 4,997,417

[45] Date of Patent: Mar. 5, 1991

[54] CENTRIFUGE

[75] Inventor: Michel Martin, Lyon, France

[73] Assignee: Robatel, Genas, France

[21] Appl. No.: 467,125

[22] Filed: Jan. 18, 1990

[30] Foreign Application Priority Data

Jan. 19, 1989 [FR] France ..... 89 00864

[51] Int. Cl.[5] ..... B04B 15/08

[52] U.S. Cl. ..... 494/85; 494/39; 494/61

[58] Field of Search ..... 494/85, 84, 43, 12, 494/39, 42, 61, 60, 62, 38, 39, 40, 41; 210/781, 782; 366/139

[56] References Cited

U.S. PATENT DOCUMENTS

| | | | |
|---|---|---|---|
| 4,226,669 | 10/1980 | Vilardi | 494/84 |
| 4,457,746 | 7/1984 | Feterl | 494/84 |
| 4,764,162 | 8/1988 | Romanauskas | 494/61 |

*Primary Examiner*—Robert W. Jenkins

*Attorney, Agent, or Firm*—Dowell & Dowell

[57] ABSTRACT

A seal system for mounting a centrifuge within an opening between an area which is sterile and a contiguous area wherein the rotating basket of the centrifuge and its enclosure are accessible within the sterile area and are hermetically sealed with respect to the contiguous area.

5 Claims, 2 Drawing Sheets

-A-
-B-
1
13
14
1a
3
16
8
10
2
10
9
11
17
4
6
5
6
12
7

CENTRIFUGE

FIELD OF THE INVENTION

The present invention relates to centrifuges.

BACKGROUND OF THE INVENTION

It is known that, in order to improve the conditions of accessibility to the rotating basket and to the accessories associated therewith, to facilitate cleaning and to allow an easy visual monitoring of the operations of filtration without dismantling parts thereof, centrifuges have been proposed in which the vessel surrounding the basket is arranged in the manner of a door articulated on the front of a fixed frame, so as to surround the basket.

The present invention is based on the observation that such a centrifuge with articulated vessel, by a relatively simple adaptation, is able to lend itself particularly well to operations of centrifugal filtration in a sterile atmosphere, for example in chemical or pharmaceutical laboratories, since the rear part of the machine containing the supply and drive devices, of which decontamination is always difficult, is capable of being disposed in an area different from that in which the front part comprising the articulated vessel and the basket on the wall of which the solid particles obtained are deposited by centrifugation.

It is such adaptation which forms the subject matter of the present invention.

SUMMARY OF THE INVENTION

To that end, the invention relates to a centrifuge of the type with articulated vessel, adapted to be installed in a gap made in a partition separating two contiguous premises or areas adapted to contain in one area, the rear drive part of the machine and in, the other, the front part which must operate in a sterile atmosphere, characterized in that, to the rear of the opening against which the edge of the vessel is applied in the position of closure, the fixed frame comprises a plate which is oriented transversely to the axis of the rotating basket and which is connected by a deformable system to the edge of the opening between the areas.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
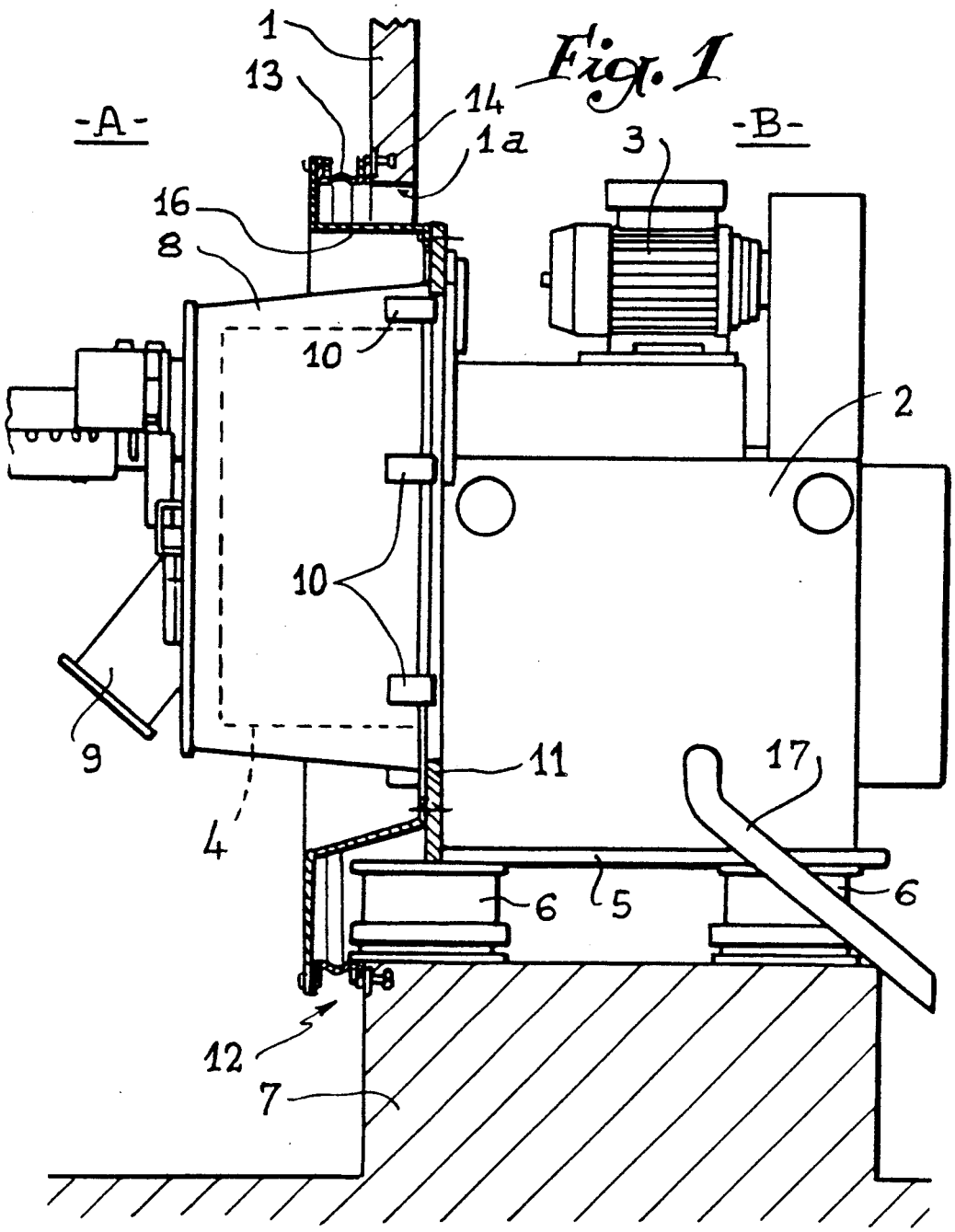
FIG. 1 is a schematic side view illustrating the installation of a centrifuge according to the present invention.

Referring now to the drawings, reference 1 designates a vertical partition separating two contiguous areas referenced A and B, which partition 1 is pierced with an opening 1*a* which may be assumed to have a substantially rectangular section. The centrifuge according to the invention is intended to be installed inside the opening 1*a* so that its front portions extend into area A, which is a sterile atmosphere, the rear portion thereof is disposed in area B which is an unmonitored atmosphere.

The centrifuge is of conventional construction concerning its general arrangement. Its fixed frame 2 which contains the lateral ballasting caissons and the hydraulic unit for controlling the conventional sampling cutter and which supports the motor 3 for driving the rotating basket 4, is mounted on a lower platform 5 which abuts by damper systems 6 against the upper face of a massive block 7 provided on the floor of area B. On the other hand, the basket 4, the vessel 8 which encloses the basket and the mechanisms associated with the bottom of the vessel 8 are located inside areas A, with tube 9 used for recovering the solid particles separated by centrifugal effect and normally collected against the inner wall of the basket.

It should be observed that vessel 4 is of the articulated type, in that it is pivotally supported by a vertical pin secured to the frame 2 and that it is capable of being maintained closed during centrifugation with the aid of a flanged mechanism 10. The open edge of the vessel is retained hermetically sealed against a bearing surface surrounding the opening of the frame 2.

Figure 2:
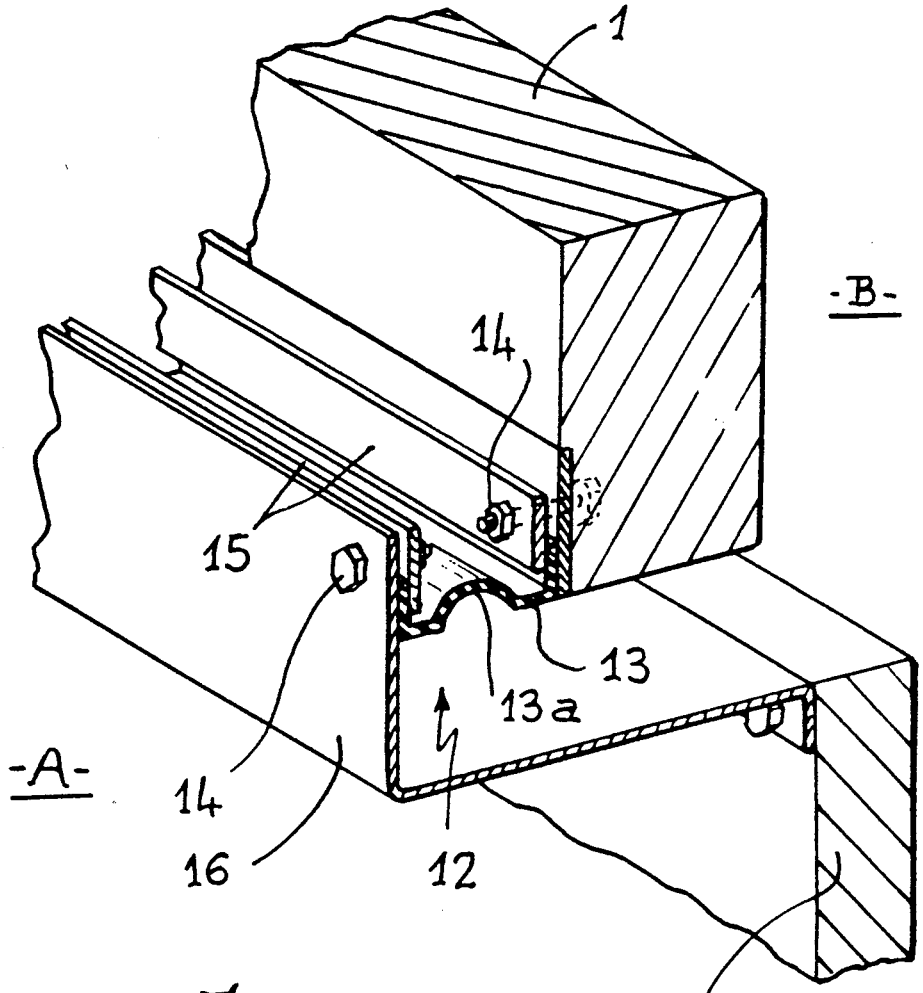
FIG. 2 is a detailed section on a larger scale.

According to the present invention, immediately to the rear of the bearing surface, the frame 2 is rendered secured, for example by welding, with a vertical plate 11 whose section in elevation is similar to that of the opening 1*a*. Furthermore, the peripheral edge of plate 11 is connected to the edge of the opening 1*a* by a deformable, strong seal system referenced 12 in FIG. 1 and of which a practical embodiment is illustrated in FIG. 2.

As shown, the seal system comprises a supple element 13 made of a tough, synthetic material, which presents a U-section. It should be observed that the central part of the element 13 comprises at least one longitudinal fold 13*a* which allows the element to be deformed like a bellows. One of the lateral arms of the U-section is fixed against the partition 1 with the aid of sealed bolts 14 and a flange 15, while the other arm is fixed, likewise with the aid of bolts 14 and a flange 15, against the outermost flange of a frame 16 of double-angle cross-section which is secured with plate 11 of the fixed frame 2 of the centrifuge.

It will be readily appreciated that plate 11 and deformable seal system 12 create a perfectly hermetic separation of the two areas A and B despite the fact that the centrifuge according to the invention lies with the opening made in the intermediate partition 1. Recovery of the solid phase, as well as packaging of the extracted product, may consequently be carried out in a perfectly sterile atmosphere in area A while the filtrate may be evacuated through a lateral tube 17 oriented rearwardly, in area B. The vibrations generated by the machine operating are absorbed by seal system 12 and are consequently not transmitted to the partition 1.

It must be noted that, although the invention appears to be more particularly applicable to horizontal-axis centrifuges, it may nonetheless be carried out with vertical-axis machines in which the vessel surrounding the rotating basket is constituted by an articulated cover.

What is claimed is:

1. In a centrifuge having a seal system for mounting the centrifuge within an opening defined by edges in a wall structure between two contiguous areas which are separated by the wall structure and where one of which is a sterile environment wherein the centrifuge includes a front portion including a basket which is rotatable about an axis and which front portion extends into the sterile environment and a rear portion which extends into the contiguous area, the improvement comprising, the seal system including a plate means disposed within the opening and transversely with respect to said axis, said plate means being secured to the rear portion of the centrifuge, a supple seal means, and means for mounting said supple seal means between said plate mean and said wall structure adjacent the edges of the opening whereby said supple seal means seals the front portion of the centrifuge relative to the opening into the contiguous area.

2. The centrifuge and seal system of claim 1 in which said supple seal means includes at least one longitudinal fold therein whereby said supple seal means is expansible transversely relative to said longitudinal fold.

3. The centrifuge and seal system of claim 2 in which said supple seal means is formed of a synthetic material which is generally U-shaped in cross section having generally parallel spaced arms, one of said arms being hermetically sealed to said wall structure.

4. The centrifuge and seal system of claim 3 in which said means for mounting said supple seal means between said plate means and said wall structure includes a frame member having inner and outer flanges, means for securing said inner flange to said plate means and said outer flange being hermetically sealed with the other arm of said supple seal means.

5. The centrifuge and seal system of claim 1 in which said rear portion of said centrifuge includes a pipe which extends laterally to said plate means for evacuating filtrate from said rear portion of said centrifuge.

* * * * *